US007794910B2

(12) United States Patent
Ron et al.

(10) Patent No.: US 7,794,910 B2
(45) Date of Patent: Sep. 14, 2010

(54) METHOD FOR CONTROLLING PARTICLE CONDUCTIVITY IN A LIQUID DEVELOPER CONTAINING YTTRIUM OR SCANDIUM CHARGE ADJUVANT

(75) Inventors: Hannoch Ron, Rehovot (IL); Dan Scheffer, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 853 days.

(21) Appl. No.: 11/701,017

(22) Filed: Jan. 31, 2007

(65) Prior Publication Data

US 2008/0182196 A1 Jul. 31, 2008

(51) Int. Cl.
*G03G 9/135* (2006.01)

(52) U.S. Cl. ..... 430/115; 430/137.22; 430/137.19

(58) Field of Classification Search ..... 430/114, 430/115, 137.22, 137.19
See application file for complete search history.

(56) References Cited

U.S. PATENT DOCUMENTS

| | | | | |
|---|---|---|---|---|
| 3,411,936 | A | 11/1968 | Roteman et al. | |
| 3,438,904 | A * | 4/1969 | Wagner | 430/115 |
| 4,707,429 | A | 11/1987 | Trout | |
| 4,950,576 | A * | 8/1990 | Larson | 430/115 |
| 5,028,508 | A * | 7/1991 | Lane et al. | 430/115 |
| 5,045,425 | A | 9/1991 | Swidler | |
| 5,225,306 | A | 7/1993 | Almog et al. | |
| 5,565,299 | A | 10/1996 | Gibson et al. | |
| 6,218,066 | B1 | 4/2001 | Zhao et al. | |
| 6,300,024 | B1 | 10/2001 | Yusa et al. | |
| 6,348,292 | B1 | 2/2002 | Pan et al. | |
| 6,756,176 | B2 | 6/2004 | Stegamat et al. | |
| 2002/0197087 | A1 | 12/2002 | Caruthers et al. | |
| 2003/0016962 | A1 | 1/2003 | Teraoka et al. | |
| 2003/0186157 | A1 | 10/2003 | Teraoka et al. | |
| 2004/0241567 | A1 | 12/2004 | Teraoka et al. | |

FOREIGN PATENT DOCUMENTS

| | | | |
|---|---|---|---|
| WO | 2005-040935 | A1 | 5/2005 |
| WO | WO 2005/040935 | A1 | 5/2005 |

OTHER PUBLICATIONS

Diamond, Arthur S & David Weiss (eds.) Handbook of Imaging Materials, 2nd ed.. New York: Marcel-Dekker, Inc. (Nov. 2001) pp. 242-257.*

* cited by examiner

*Primary Examiner*—Christopher RoDee

(57) ABSTRACT

In one aspect of the present system and method, a method for enhancing a chargeability of a liquid developer includes presenting a liquid developer and combining a Group 3 based charge adjuvant with the liquid developer.

16 Claims, 10 Drawing Sheets

METHOD FOR CONTROLLING PARTICLE CONDUCTIVITY IN A LIQUID DEVELOPER CONTAINING YTTRIUM OR SCANDIUM CHARGE ADJUVANT

BACKGROUND

With the rapid development of digital image technology, traditional monochromatic electrophotographic printing is gradually being replaced by full color, high image quality electrophotographic printing. Electrophotographic printing technology enables the making of good quality in-house prints on-demand without requiring professional skills such as those skills used to perform conventional offset printing (lithographic printing) in a printing house.

In the art of electrostatic photoprinting or photocopying, a latent electrostatic image is generally produced by first providing a photoconductive imaging surface with a uniform electrostatic charge, e.g. by exposing the imaging surface to a charge corona. The uniform electrostatic charge is then selectively discharged by exposing it to a modulated beam of light corresponding, e.g., to an optical image of an original to be copied, thereby forming an electrostatic charge pattern on the photoconductive imaging surface, i.e. a latent electrostatic image. Depending on the nature of the photoconductive surface, the latent image may have either a positive charge (e.g. on a selenium photoconductor) or a negative charge (e.g. on a cadmium sulfide photoconductor). The latent electrostatic image can then be developed by applying to it oppositely charged pigmented toner particles, which adhere to the undischarged "print" portions of the photoconductive surface to form a toner image which is subsequently transferred by various techniques to a copy sheet (e.g. paper).

SUMMARY

In one aspect of the present system and method, an exemplary method for controlling particle conductivity in a liquid developer used for developing an electrostatic latent image includes disposing an insoluble Yttrium or Scandium based charge adjuvant in a ready made liquid developer.

BRIEF DESCRIPTION OF THE DRAWINGS

The accompanying drawings illustrate various embodiments of the present system and method and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

Figure 1:
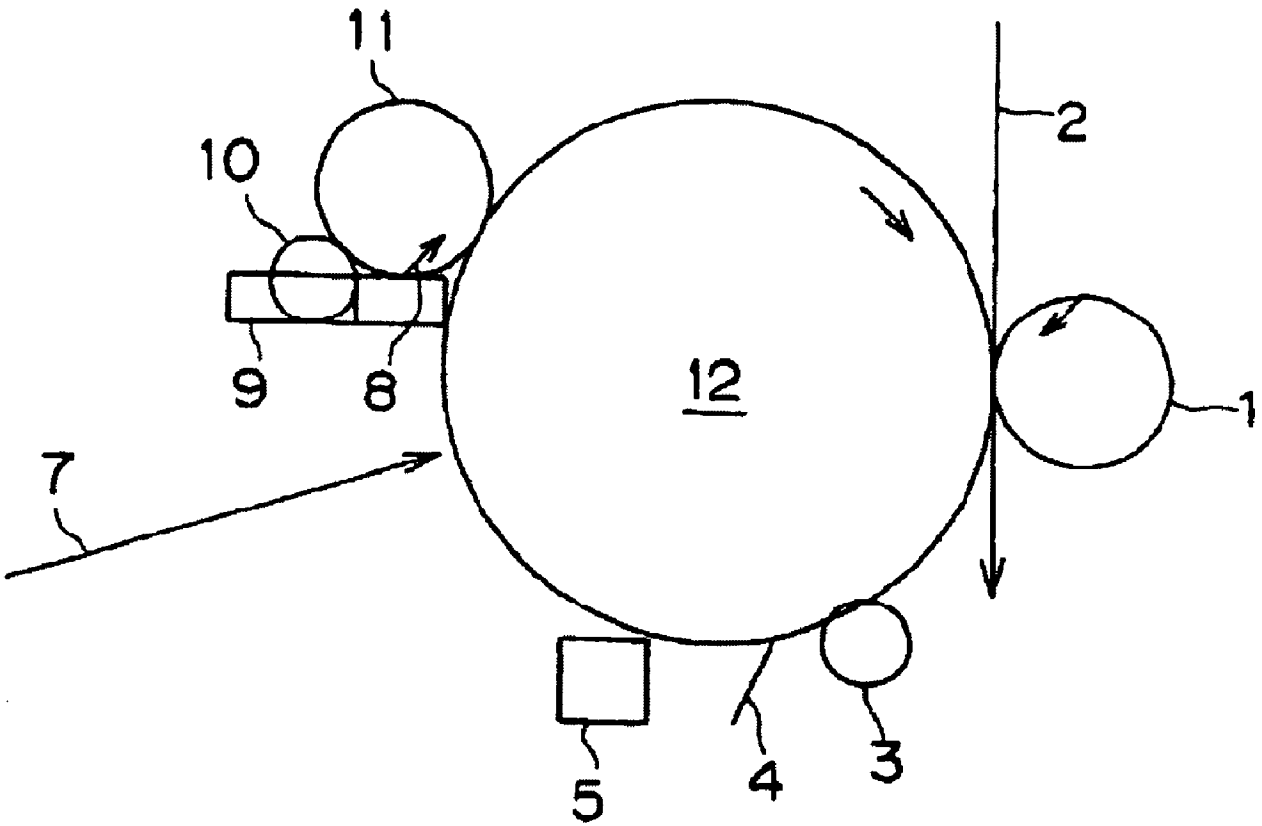
FIGS. 1-4 are schematic views showing electrophotographic image forming devices, according to exemplary embodiments.

The present specification discloses an exemplary system and method for controlling particle conductivity in a liquid developer used for developing an electrostatic latent image. According to one exemplary embodiment, an insoluble Yttrium or Scandium based charge adjuvant is selectively disposed in a ready made liquid developer to increase the charge of the liquid developer. According to one exemplary embodiment, the charge of the liquid developer may be controlled by varying any one of the concentration of the disclosed Yttrium or Scandium based charge adjuvant, the dispersion/grind time, and/or the temperature of the liquid developer when the charge adjuvant is distributed therein. Further details of the present systems and method for controlling particle conductivity will be provided below.

Before particular embodiments of the present system and method are disclosed and described, it is to be understood that the present system and method are not limited to the particular process and materials disclosed herein as such may vary to some degree. It is also to be understood that the terminology used herein is used for the purpose of describing particular embodiments only and is not intended to be limiting, as the scope of the present system and method will be defined only by the appended claims and equivalents thereof.

As used in the present specification and in the appended claims, the term "electrophotographic printing" is meant to be understood broadly as including any number of methods that use light to produce a change in electrostatic charge distribution to form a photographic image including, but in no way limited to, laser printing, photocopying, and the like.

Further, as used herein, the term "Group 3" is meant to be understood as referring to any element contained in Group 3 of the periodic table of the elements including, but in no way limited to, Scandium, Yttrium, Lutetium, and Lawrencium. Additionally, as used in the present specification, the term "particle conductivity" will be abbreviated as "PC" and the term direct current conductivity of a species other than the toner particles will be abbreviated as "DC".

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of approximately 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc.

In the following description, for purposes of explanation, numerous specific details are set forth in order to provide a thorough understanding of the present system and method for controlling particle conductivity in a liquid developer used for developing an electrostatic latent image. It will be apparent, however, to one skilled in the art, that the present system and method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

FIGS. 1-4 illustrate various electrophotographic image forming devices, according to the present exemplary embodiments. Referring initially to FIG. 1, a photoconductor (12) (such as organic photo-semiconductor, selenium or amorphous silicone) rotating in the direction of the arrow and charged by a corona discharger (5) creating an exposing section (7) for writing. A developing roller (11) is supplied and applied uniformly with a developer from a developer container (9) by a roller (10). The developer layer thus formed on the developing roller (11) is optionally impressed with a voltage by a corona discharger (8) and develops a latent image on the photoconductor. Each of the rollers may be made of a metal, rubber, plastic or sponge and may be a grooved roll such as a wire bar or a gravure roller.

The toner image thus formed on the photoconductor (12) is transferred to a transfer medium (2) by a transfer roller (1). The transfer is by pressure, corona discharge, heat, a combination of heat and pressure, a combination of corona and pressure or a combination of corona and heat, so that an image is formed on the transfer medium.

According to one exemplary embodiment, residual toner on the photoconductor is removed by cleaning roller (3) and a cleaning blade (4) to be ready for the next image formation.

Figure 2:
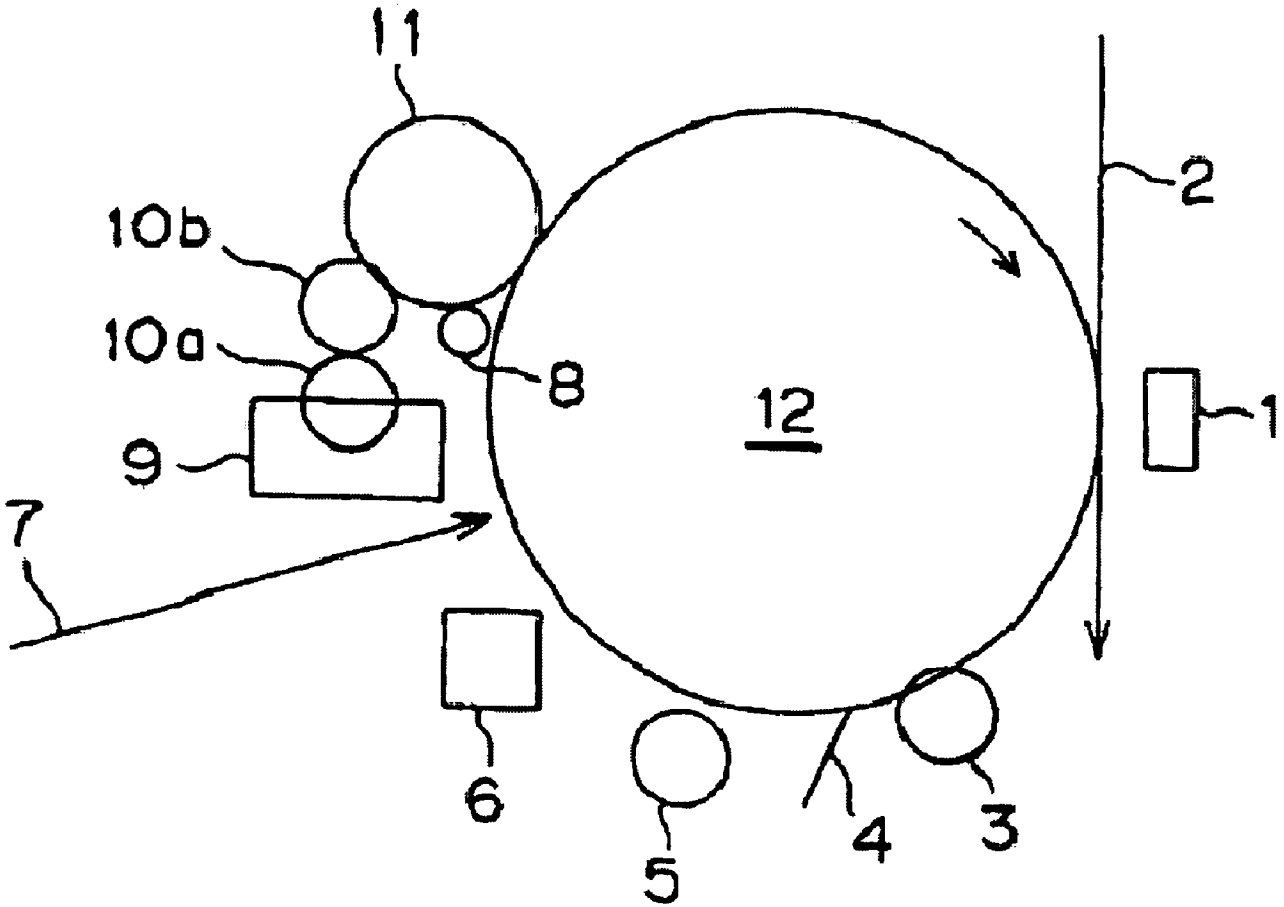

FIG. 2 differs from FIG. 1 in that the former has a roller (6) for pre-wetting with a carrier liquid. The developer is applied from a developer container to a developer roller (11) through rollers (10*a*, 10*b*). The toner layer thus applied is impressed with a direct current voltage by a corona discharger (8). The developing roller (11) of FIG. 2 has a larger width of contact with a photoconductor as compared with that in the case of FIG. 1, so that the latent image is sufficiently developed. The toner image developed on the photoconductor is transferred to a transfer medium (2) by a corona discharger (1) to form an image thereon.

Figure 3:
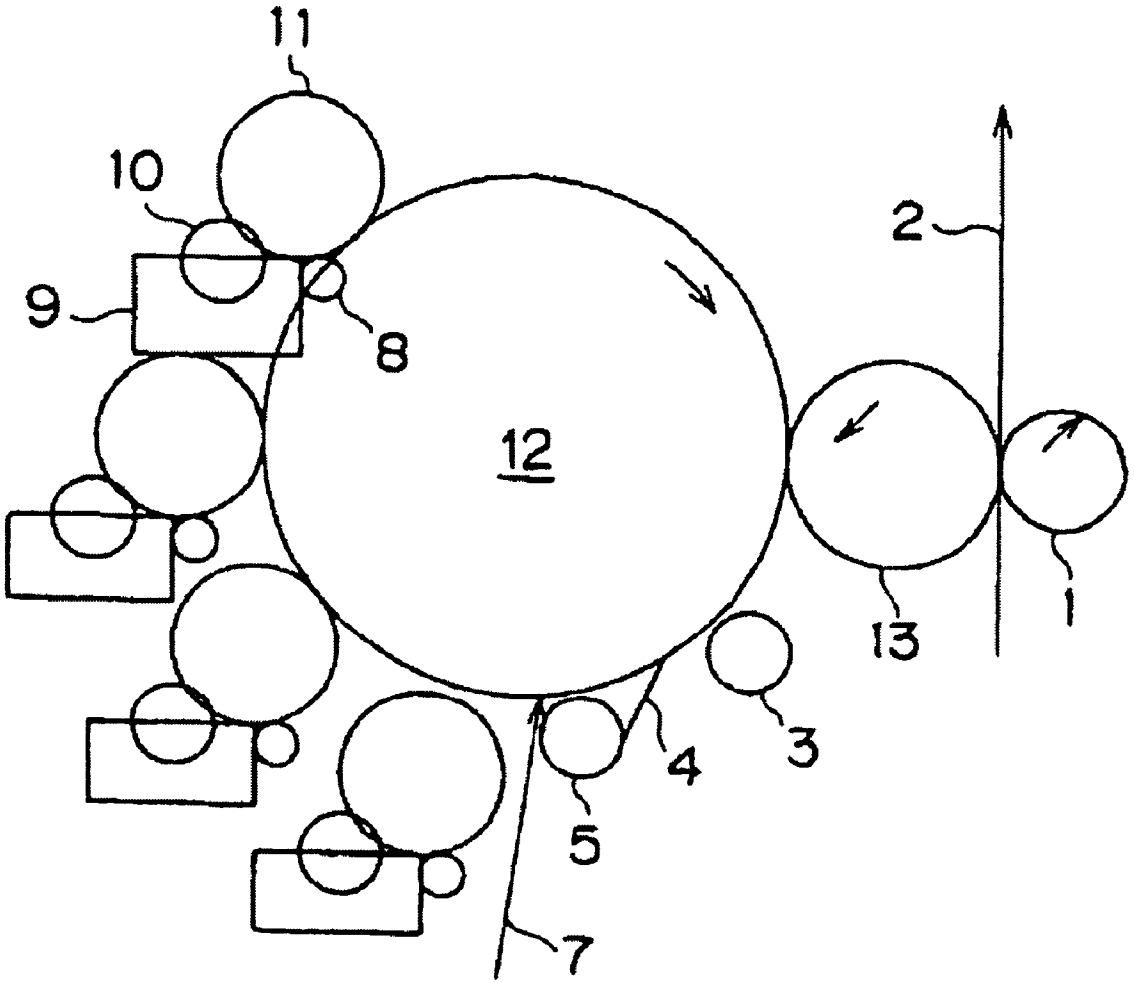

FIG. 3 illustrates an embodiment for a developing system for generating color copies. Developer containers (9) for respective yellow, magenta, cyan and black toners are disposed on a photoconductor. A latent image on the photosensitive member (12) is developed with each of the toners and the developed image is transferred to an intermediate transfer medium (13). Thereafter, the image is transferred to a transfer medium using a transfer roller (1) by pressure, corona, heat, etc.

Figure 4:
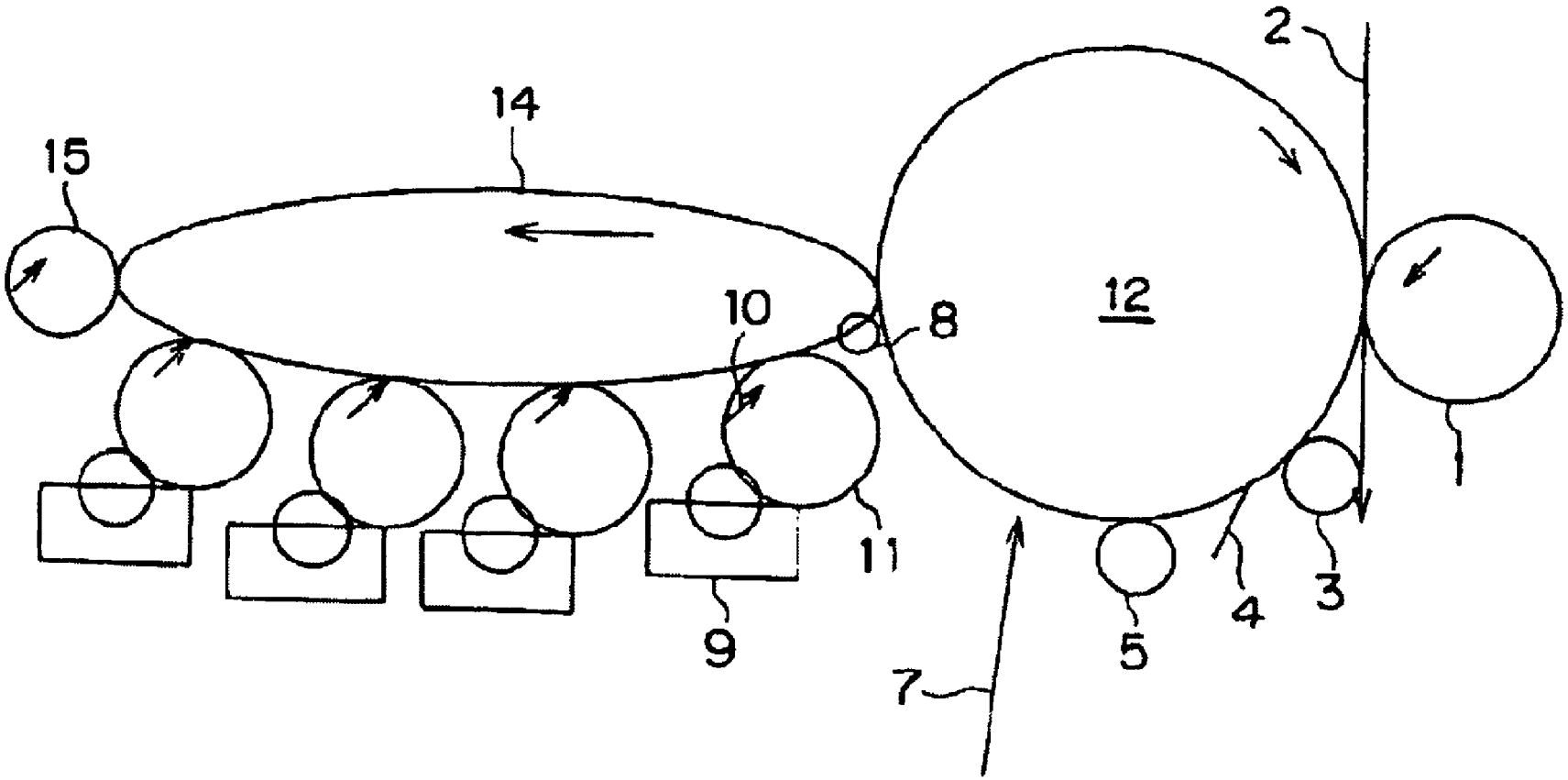

FIG. 4 illustrates an image forming process for color copy. Similar to FIG. 3, developer containers (9) for respective yellow, magenta, cyan and black toners are disposed. A layer of the developer is applied to a belt (14) and develops a latent image on a photoconductor (12). The developed image is transferred to a transfer medium (2). The belt (14) for applying the developer layer is cleaned by a cleaning roller (15) and a cleaning blade.

As illustrated above, each electrophotographic imaging system includes a liquid developer that is used for developing a latent image. Specifically, according to one exemplary embodiment, the liquid developer includes toner particles that are combined with a binder and a charge adjuvant. According to this exemplary embodiment, the charged toner particles then interact with an electrostatic latent image to form a desired image on a desired medium.

The charge on the toner particle in the liquid developer is strongly related to the mobility of the particle. The higher the charge on the particle the faster the particle moves under the applied electrical field in the development zone. High mobility results in improved image density, image resolution, and better transfer efficiency. U.S. Pat. No. 5,565,299, the disclosure and references cited therein of which is incorporated herein by reference, describes the relationship between particle charge (mobility) and the advantages described above.

Generation of the desired charge on the toner particle is attained by incorporating one or both of charge control agents and charge adjuvants into the dispersed toner particles in the liquid developer and incorporating charge directors into the dispersing liquid.

Preparing a liquid developer for an electrophotographic imaging system may be performed by any number of known methods. For example, according to one exemplary embodiment, several methods are described in U.S. Pat. No. 5,565,299 and W.O. 2005/040935 the disclosure and references cited therein of which are incorporated herein by reference in their entireties. As described in the incorporated references, the charge control agents and charge adjuvants used to generate or enhance the desired charge on the toner particles are usually added to the developer prior to or during a grinding and dispersion process. Preparation of the liquid developer includes controlling a delicate balance between a number of properties including, but not limited to, chargeability of the developer, particle size, optical density, and viscosity, among others.

Controlling the chargeability of the liquid developer during preparation of the developer has proven to be very important and somewhat challenging. For example, image formation may be compromised if a particle does not have sufficient chargeability. Additionally, high speed-printing requires an increase of the charge on the particle. In order to increase the charge of the particles, the type and amount of the charge control agent and the charge adjuvants may be modified. However, modifying the type and/or amount of the charge control agent may subsequently change the viscosity of the dispersion and reduce the overall efficiency of the grinding process. Modifying the charge adjuvants may have a negative influence on developer properties such as optical density, particle size, and particle size distribution. As a result prolonged grinding time may be required to achieve the desired properties.

Furthermore, chargeability of liquid developer may be reduced over time. Often, long term storage has an adverse effect on the chargeability of the developer. However, according to one exemplary embodiment, the present exemplary system and method allow for recovery of the required chargeability of the liquid developer using simple means without compromising other properties such as optical density, particle size, and particle size distribution. Consequently, according to the present exemplary system and method, an end user can recover diminished charging properties and thus, the shelf life of the commercial products containing the liquid developer can be expanded.

According to the present exemplary system and method, a charge adjuvant based on Yttrium and/or Scandium compounds, as well as other Group 3 elements in the periodic table can be used as charge adjuvants. According to one exemplary embodiment, the Yttrium and/or Scandium based compounds retain efficacy if ground for a short period of time compared to charge adjuvants such as aluminum stearate. This property permits adding the Yttrium and/or Scandium based compounds to the liquid developer at the end of the manufacturing process, for example.

According to the present exemplary system and method, the reduced grind time preferred for the Yttrium and Scandium based charge adjuvants allows them to be used for a new method disclosed herein for liquid developer preparation. According to this exemplary system and method, the chargeability of the developer is attained after all the other properties such as particle size, particle size distribution, and color strength (optical density) have met desired specifications.

In addition to preparing a new developer, the present exemplary Yttrium and Scandium based compounds can be used for increasing the chargeability of a diluted solution of liquid toner. Specifically, liquid toners are supplied in a concentrated form and diluted before application in the printing system. The low grind time and high chargeability of the present exemplary Yttrium and Scandium based charge adjuvants allows an end user of the liquid toner to control the charging of the developer.

According to one exemplary embodiment, enhancing the chargeability of a diluted ready made developer includes adding a suitable charge adjuvant to the ready made developer in a concentrated form and introducing the adjuvant into the dispersed ingredient of the liquid developer by grinding.

Specifically, according to one exemplary embodiment, the chargeability of a ready made developer used in a slow printing system was enhanced upon introduction of an Yttrium based charge adjuvant into the ready made developer. According to this exemplary embodiment, the charge adjuvant was introduced into the ready made developer upon grinding the Yttrium based charge adjuvant into a ready made liquid developer for 30 minutes. The treated developer was then introduced into a fast printing system. The printing quality was improved significantly compared to the previously untreated developer.

According to the present exemplary system and method, use of an Yttrium and/or Scandium based charge adjuvant that may be added after the developer is produced allows for controlled enhancement of the mobility of liquid developer after production, thereby providing an independent and relatively simple process for determination of the chargeability of a developer once other important properties such as pigment dispersion i.e. color strength, particle size, and distribution, among other properties, have been fulfilled according to conventional production process. This exemplary system and method allows for the extended shelf life of liquid developer upon restoration of chargeability some time after production stage, and may allow for control of chargeability in the printing system. This ability to charge a ready made liquid developer saves both time and resources. Illustrative examples and details of the addition of a charge adjuvant based on Yttrium and Scandium or other Group 3 elements to a prepared developer are provided below.

ILLUSTRATIVE EXAMPLES

The following example illustrates the embodiments of the system and method that are presently best known. However, it is to be understood that the following is only exemplary or illustrative of the application of the principles of the present system and method. Numerous modifications and alternative compositions, methods, and systems may be devised by those skilled in the art without departing from the spirit and scope of the present system and method. The appended claims are intended to cover such modifications and arrangements. Thus, while the present system and method has been described above with particularity, the following examples provide further detail in connection with what is presently deemed to be the most practical and preferred embodiments of the present system and method.

According to the present exemplary system and method, experiments were performed to test the viability of introducing a charge adjuvant based on a Group 3 element such as Yttrium or Scandium to a prepared developer in order to enhance the charge of the liquid developer. Specifically, various formulations, temperatures, concentrations, and times were tested to evaluate the effectiveness of the above-mentioned charge adjuvant combinations on 1) enhancing the chargeability of a ready made developer material, 2) printability of a developer material containing the above-mentioned charge adjuvant combinations, and 3) enhancing the chargeability of a diluted developer using a non-industrial dispersing tool. Each experiment, as well as the observed result of each experiment will be provided in detail below.

According to a first exemplary experiment, a ready made liquid developer was used to test the ability of a Yttrium and/or a Scandium based charge adjuvant to enhance the chargeability of a readymade developer. Specifically, Electroink Mark 3.1 (El 3.1) liquid developer was used in the first exemplary experiment as a commercial ready made developer supplied by HP Indigo. According to the first experiment, a number of traditional aluminum based charge adjuvants as well as Yttrium and Scandium based charge adjuvants, in various concentrations, were tested with the liquid developer. During the experiment, the various charge adjuvants included the following:

1. Aluminum stearate supplied by sigma Aldrich Israel.
2. Aluminum laureate supplied by Dalatec Corporation 2175 Wantagh Ave.Wantagh, N.Y. 11783.
3. Yttrium (Ill) 2-ethylhexanoate 99.9% CAS 114012-65-6, referred to as Y-1, supplied by sigma Aldrich Israel.
4. Yttrium (III) acetylacetonate hydrate 99.99% CAS 207801-29-4, referred to herein as Y-2, supplied by sigma Aldrich Israel.
5. Yttrium (III) tris (2,2,6,6-tetramethyl-3,5-heptanedionate) CAS 15632-39-0, referred to herein as Y-3, supplied by sigma Aldrich Israel.
6. Yttrium stearate CAS 81518-51-6, referred to herein as Y-0, supplied by Wako, Japan.
7. Scandium(III) tris(2,2,6,6-tetramethyl-3,5-heptanedionate) hydrate CAS #307532-33-8 referred to herein as S-1, supplied by sigma Aldrich Israel. According to the present exemplary experiment, Isopar L (isoparaffinic hydrocarbon liquid commercially marketed by EXXON) was used as the dispersing media as well as liquid carrier in all of the experiments.

Once the adjuvants and the liquid developer were acquired, an Attritor MODEL 01-HD (Union Process) containing 3/16 inch chrome balls steel media cooled to ca. 30° C. was charged with 200 gram El 3.1 and a charge adjuvant. The mixture was then ground for approximately 30 minutes. A 2% solution (diluted by Isopar L) of the resulting mixture was charged by NCD 10 (commercial charge director from HP Indigo) and equilibrated over night before the particle conductivity was determined.

Enhancement in chargeability of El 3.1 was determined for different amounts of each of the above adjuvants. For each of the above charge adjuvants, 6 different concentrations namely 1, 2, 3, 4, 6 and 8%, (except 8% for Y-2 and 3% as well as 6% for S-1), on the solids in the developer were tested, as illustrated in Table 1 below.

TABLE 1

| | | Concentration | | | | | | | | | | | |
|---|---|---|---|---|---|---|---|---|---|---|---|---|---|
| | | 1% | | 2% | | 3% | | 4% | | 6% | | 8% | |
| | Adjuvant | PC | DC | PC | DC | PC | DC | PC | DC | PC | DC | PC | DC |
| 1 | Aluminum Stearate | 120 | 2 | 158 | 3 | 170 | 3 | 187 | 3 | 192 | 10 | 179 | 11 |
| 2 | Aluminum Laurate | 135 | 3 | 155 | 3 | 173 | 2 | 175 | 3 | 185 | 4 | 209 | 4 |
| 3 | Y-0 | 95 | 3 | 101 | 3 | 99 | 3 | 84 | 3 | 89 | 3 | 81 | 3 |
| 4 | Y-1 | 98 | 2 | 105 | 3 | 143 | 3 | 160 | 3 | 505 | 10 | 531 | 11 |
| 5 | Y-2 | 88 | 4 | 88 | 7 | 98 | 5 | 109 | 6 | 237 | 8 | | |
| 6 | Y-3 | 100 | 3 | 77 | 2 | 109 | 3 | 150 | 3 | 326 | 4 | 415 | 6 |
| 7 | S-1 | 211 | 5 | 276 | 5 | | | 306 | 6 | 348 | 7 | | |

Figure 5:
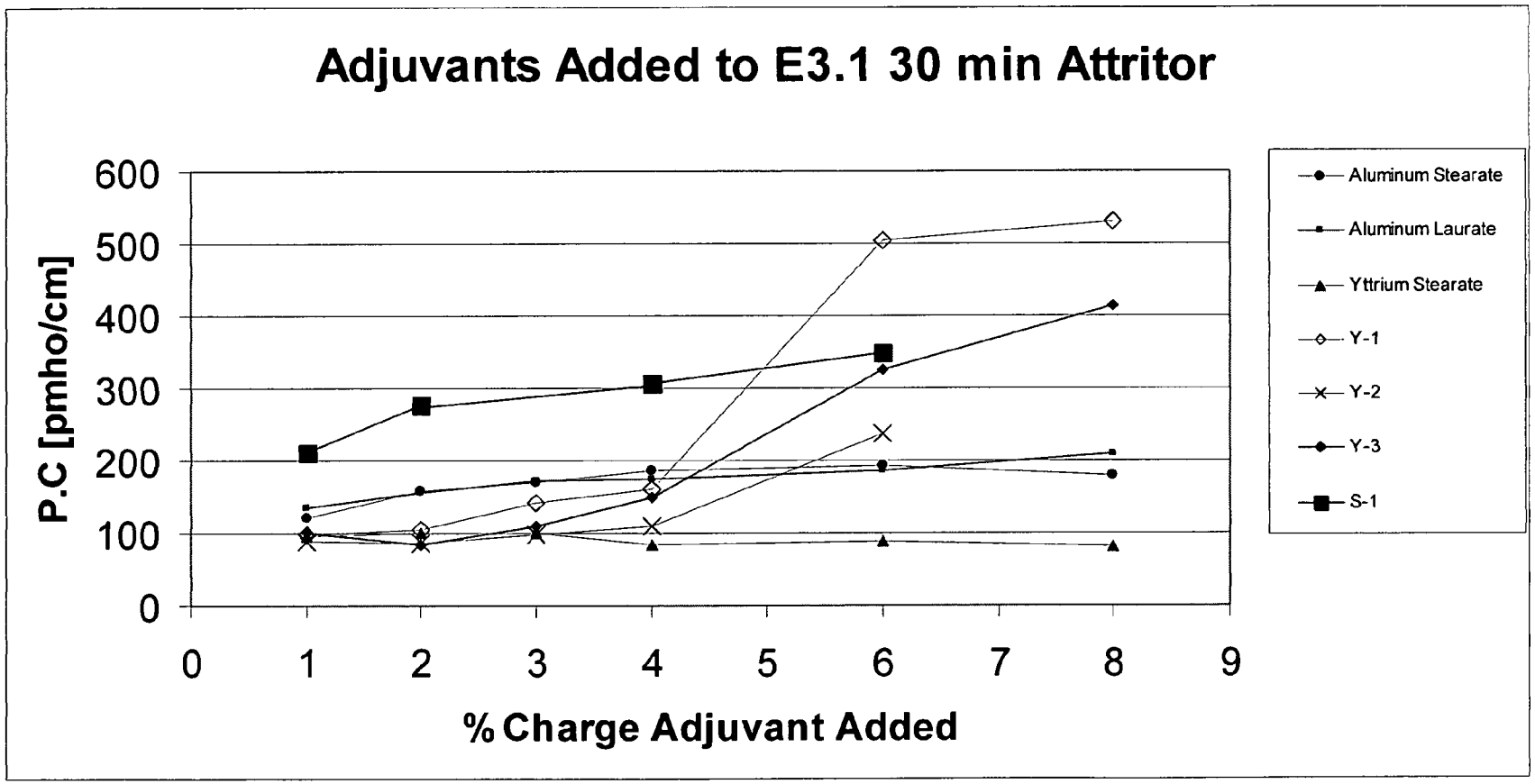
FIG. 5 is a chart illustrating the charge imparted to a liquid developer as a function of charge adjuvant added, according to one exemplary embodiment.

The results of the chargeability tests for the various concentrations of the 7 charge adjuvants are illustrated in FIG. 5. According to one exemplary embodiment, the charge adjuvant adheres to the solid particles of the developer, thereby enhancing its charge. As known in the art, the charge adjuvants are processed together with the solid ingredients of the developer in order to provide good contact between the developer solids and the non soluble charge adjuvants. While traditional charge adjuvants require large grinding times with the developer solids to impart sufficient charge, the present Yttrium and Scandium based charge adjuvants (Y-1, Y-2, Y-3 and S-1) evidently impart sufficient charge into the developer particles upon very short grinding process where upon choosing the proper concentration a desired PC can be obtained. As illustrated in Table 1 (rows 4, 5, 6 and 7) and FIG. 1, controlled enhancement of particle conductivity of a ready made liquid toner may be effectively performed by adding the present Yttrium and/or Scandium based charge adjuvant after compilation of the manufacturing of the liquid developer. As illustrated in FIG. 5, when between approximately 4 and 6% Yttrium charge adjuvant and approximately 1 to 2% of Scandium is added to the developer, large increases in chargeability are realized.

Additionally, as illustrated in Table 1 and FIG. 5, the present Yttrium and Scandium based charge adjuvants are substantially different from traditional charge adjuvants based on aluminum. According to the illustrated results, the Yttrium and Scandium based charge adjuvants capable of imparting a desired charge with little grind time include, but are in no way limited to, Yttrium (III) 2-ethylhexanoate, Yttrium (III) acetylacetonate hydrate, Yttrium (III) tris (2,2,6,6-tetramethyl-3,5-heptanedionate) and Scandium(III) tris (2,2,6,6-tetramethyl-3,5-heptanedionate) hydrate. While all of the acceptable Yttrium based charge adjuvants contain a Yttrium atom, the results exhibited by Yttrium stearate (see Table 1 row 6) demonstrate that the combination between Yttrium and stearic acid in principle is not different than the combination of stearic acid and aluminum. Note that the aluminum stearate PC values are higher than the Yttrium stearate. Consequently, the inclusion of Yttrium by itself does not assure that the material is suitable for the present system and method.

In order to evaluate a potential adjuvants similar to the disclosed Yttrium and Scandium based adjuvants, the potential adjuvant was dispersed into "varnish" (Nucrel 699, marketed by DuPont, for example is dissolved upon heating in the carrier liquid, such as Isopar L, and than cooled while mixing for example see in WO 2005/040935) and compared to the previously disclosed Yttrium and Scandium based adjuvants. For example, when one of the Yttrium based adjuvants Y-1, Y-2, or Y-3 were dispersed in the varnish, such as Yttrium tris (2,2,6,6-tetramethyl-3,5-heptanedionate), the Yttrium based charge adjuvant showed significant PC. In contrast, Iron tris (2,2,6,6-tetramethyl-3,5-heptanedionate) as well as aluminum tris (2,2,6,6-tetramethyl-3,5-heptanedionate) processed under the same conditions showed no PC. Consequently, the metallic based suitable charge adjuvants for the present exemplary system and method include a suitable combination of a metal atom or several atoms and a chelate or ion.

Figure 6:
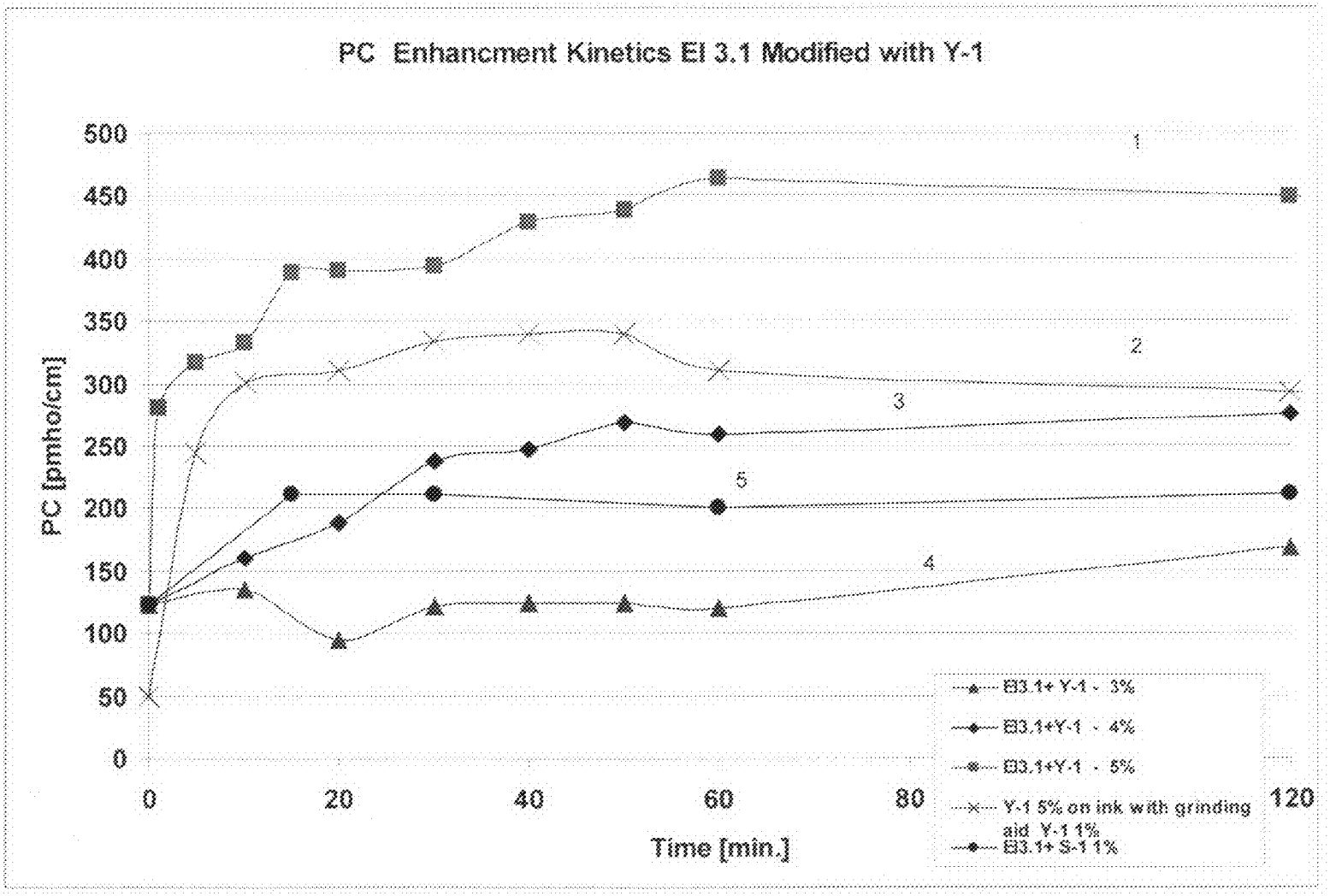
FIG. 6 is a chart illustrating charge enhancement kinetics of various charge adjuvants as a function of grind time, according to one exemplary embodiment.

While aluminum stearate has traditionally been used as a charge adjuvant, it has also been used for some time as a grinding aid. The present Yttrium and Scandium based charge adjuvants were also tested for use as a charge adjuvant. According to a first experiment, the results of which are illustrated in FIG. 6, Y-1 was added to El 3.1 using a MODEL 01-HD attritor as described above. Samples were taken out of the attritor after various times and the PC of the treated developer was determined. According to this experiment, the official PC of the commercial El 3.1 was 123 pmho/cm as seen in FIG. 5.

Treating the El developer with 3% Y-1 under the defined conditions did not show any significant improvement in the PC, as shown by line 3 of FIG. 6. However, adding 4% and 5% Y-1, lines 2 and 1 of FIG. 2, respectively, show a significant effect on the PC of El 3.1. Note that only 1% of S-1 added to El 3.1 (FIG. 6) gave a significant increase in the charging of El 3.1. it is evident that the Scandium compared to Yttrium compounds above is very active at relatively low concentrations It is important to emphasize that the DC values are considered low even when 8% of the disclosed charge adjuvants were added to the El 3.1.

Continuing with FIG. 6, the PC for 5% reaches a maximum of approximately 460 pmho/cm and then begins to decrease. After 24 hours, the PC had decreased to approximately 60 pmho/cm, illustrating the property of high charge at a low grind time. In a different experiment liquid developer based on the formulation of El 3.1 was prepared in a MODEL 01-HD attritor replacing the aluminum stearate in the formulation by 2% (on solids weight) Y-1, Y-2 or Y-3. After 24 hours, the PC of all 3 different developers based on the Y-1, Y-2 and Y-3 showed PC in the order of 60 pmho/cm. PC in the order of 50 pmho/cm was determined for a developer based on El 3.1 where the aluminum stearate was replaced by 1% (on solids weight) of Y-1. Prolonged grinding of Scandium (III) tris(2,2,6,6-tetramethyl-3,5-heptanedionate) hydrate resulted in a decay of the PC below the initial value of El 3.1. These results suggest that prolonged grinding of the Yttrium and Scandium based charge adjuvants damages the compounds and their ability to charge liquid developers is diminished.

Figure 7:
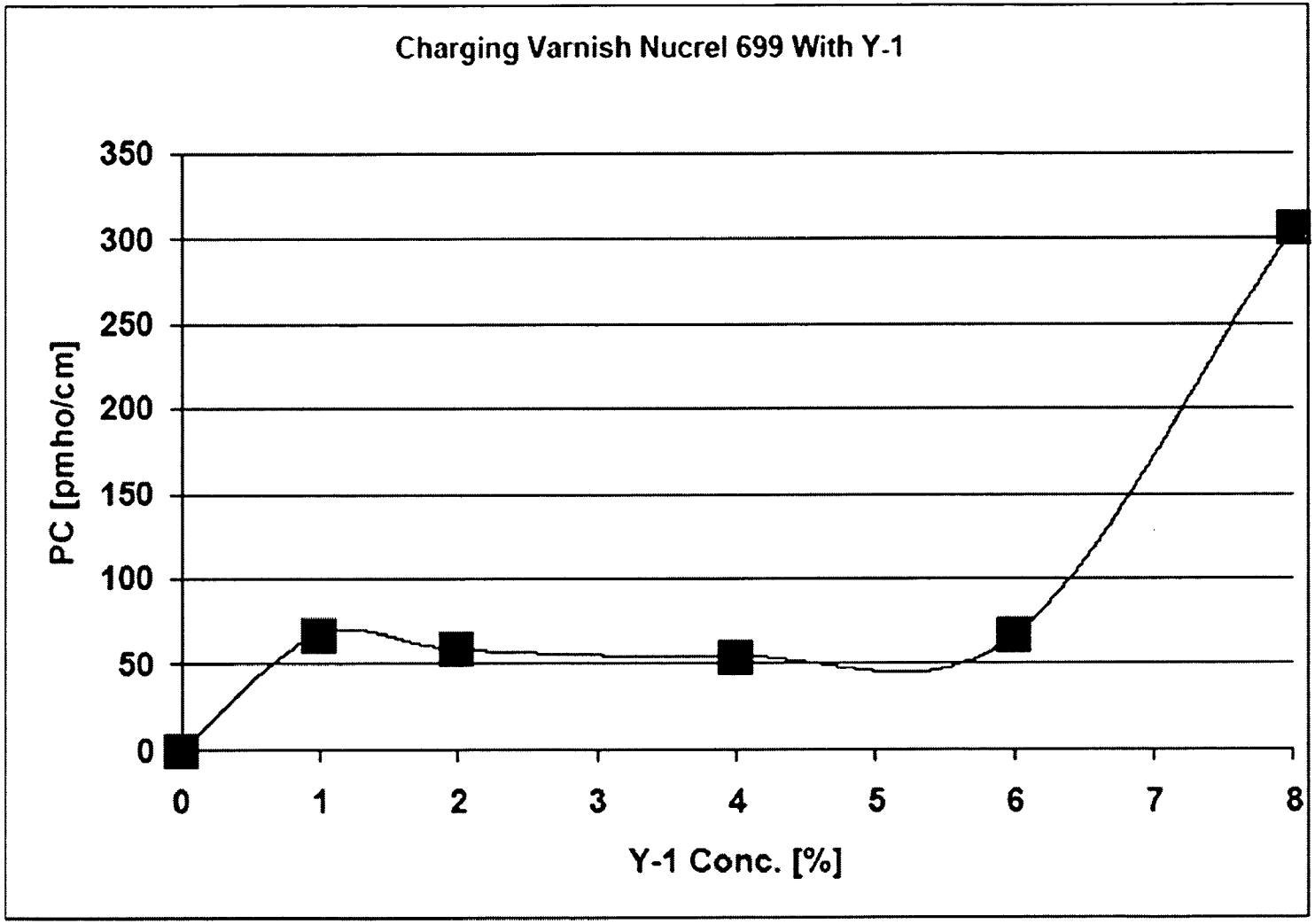
FIG. 7 is a chart illustrating the chargeability of a varnish with an Yttrium based charge adjuvant, according to one exemplary embodiment.

Effect of concentrations of the present exemplary Yttrium based charge adjuvants was also tests as illustrated in FIG. 7. As in the former example, attritor MODEL 01HD was charged with 200 gram of Varnish made of Nucrel 699 (22.51% solids). Once the varnish was prepared, Y-1 was added to the varnish at various levels and ground for 30 minutes. The charging of Y-1 at various concentrations was then observed and plotted in FIG. 7. As illustrated in FIG. 7, the varnish was charged to various degrees by the Y-1, depending on the concentration, with a very short grind time (30 minutes). In contrast to the pigmented systems (El 3.1 for example), significant increase in PC was achieved by introducing relatively high levels of Y-1 charge adjuvant.

Additionally, it was observed that the PC of the varnish could be increased further upon grinding the varnish at elevated temperature. For example, according to one exemplary experiment, 6% (by solids weight) of Y-1 was ground for 30 minutes at 30° C., producing a PC of 67 pmho/cm compared to 122 pmho/cm measured for the same composition of varnish+Y-1 when grinded 30 min at 40° C.

Another varnish made from a polyethylene wax (ACUMIST B-6, referred to as HPB, 18% (by solids weight) in Isopar L) was charged to a level of 77 pmho/cm upon dispersion of Y-1 5% (by solids weight) using MODEL 01-HD attritor as described above. Charging of the polyethylene wax indicates that the present exemplary Yttrium based charge adjuvants are not dependent upon the presence of acidic groups in the resin comprising the varnish such as in Nucrel 699.

As mentioned previously, the present Yttrium and Scandium based charge adjuvants may also be functional as a grinding aid. According to one exemplary embodiment, Y-1 was shown to be an efficient grinding aid. According to this exemplary experiment, a liquid developer based on El 3.1 was produced. However, in the present experiment, the aluminum stearate was replaced by 1% (on solids weight) of Y-1 and was ground in a MODEL 01-HD attritor at 18% solids for 24 h as described above. Particle size of 5.4 micron and a tail (% particles above 20 microns) of 4.2% compared to 6.54 micron and tail of 7.54% for El 3.1 ink as determined by a Mastersizer 2000 from Malvern Instruments, UK. The particle size of the liquid developer (based on El 3.1) where the aluminum stearate was replaced by Y-1 was further reduced once an additional portion (5% on the solids) of Y-1 was added and the liquid toner was grinded for another 30 minutes as shown in FIG. 8 and 9.

Figure 8:
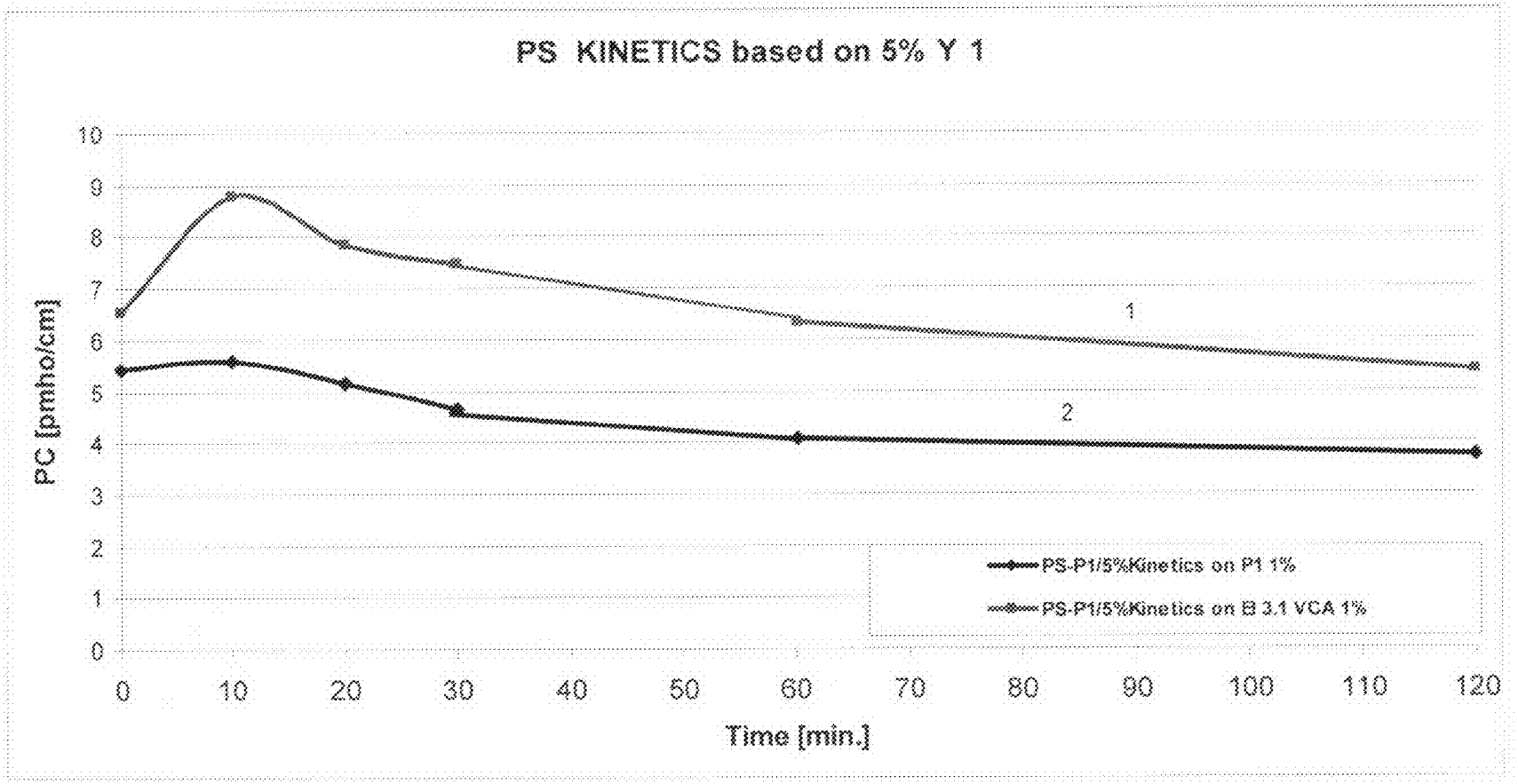
FIG. 8 is a chart illustrating the effects of introducing an Yttrium based charge adjuvant as a grinding aid, according to one exemplary embodiment.
Figure 9:
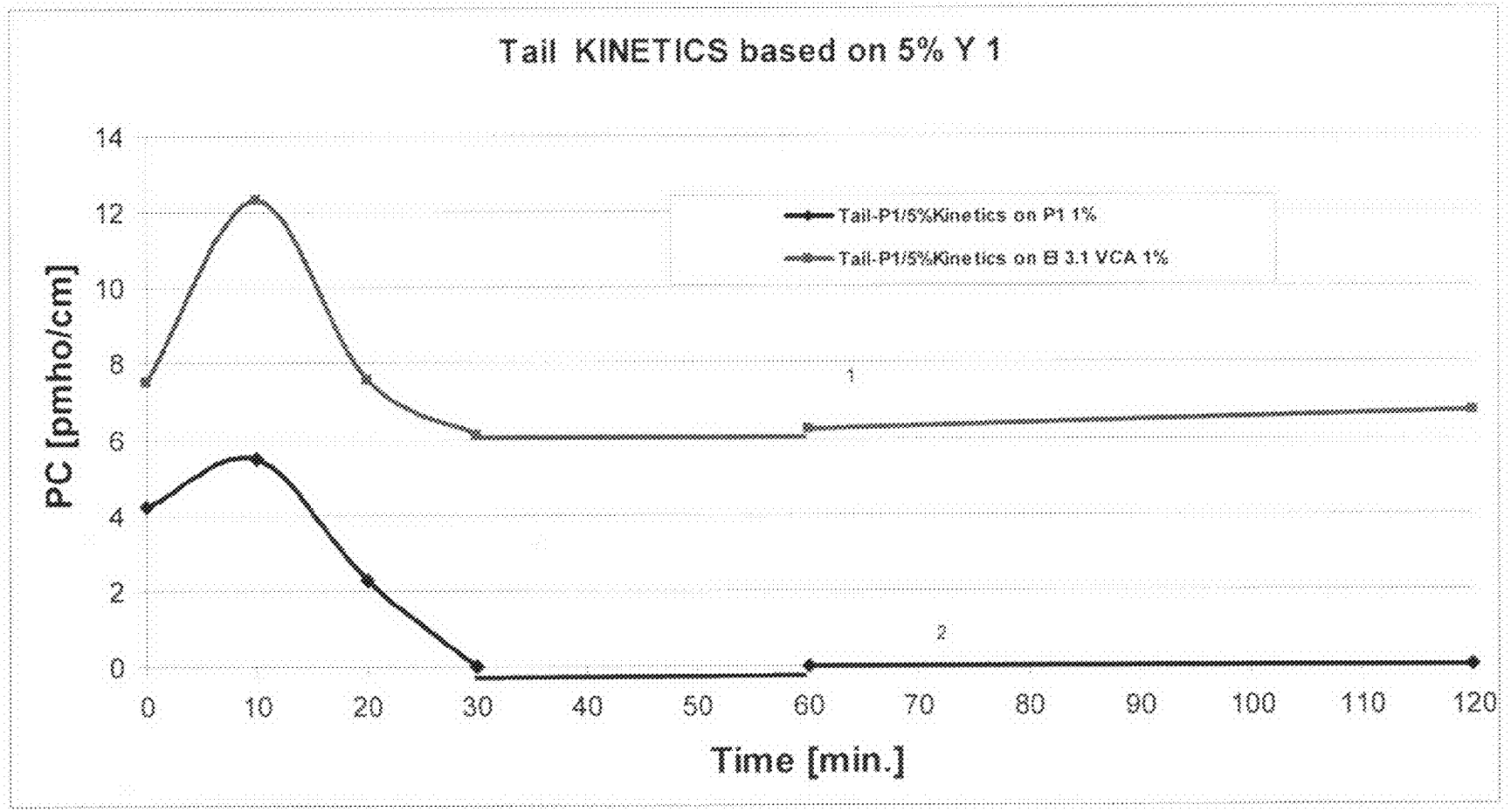
FIG. 9 is a chart illustrating the effect of using an Yttrium based charge adjuvant as a grinding aid on the tail kinetics of a developer, according to one exemplary embodiment.

As observed and shown in FIGS. 8 and 9, the Yttrium and Scandium based charge adjuvants exert a positive effect on the particle size while enhancing the particle conductivity using the disclosed method. The particle size and the tail of a treated liquid developer decrease upon grinding for relatively short time. The effect is even more prominent when the liquid toner is ground with Y-1 as a grinding aid (1%) as shown by line 2 of FIGS. 8 and 9, compared to liquid developer ground with aluminum stearate as a grinding aid, shown by line 1, FIGS. 8 and 9. It is clear that the reduction of particle size denote smaller particles with increased surface area. One can suggest that the increase in surface area may explain the increased chargeability of the toner particles.

The effect of an additional 5% of Y-1 was tested on a more advanced version of ElectroInk namely El 4.0 (magenta). Original particle size of the ready made El 4.0 was 3.5 micron and the tail was 12.95%. After grinding for 30 minutes the particle size was reduced to 2.3 micron and the tail value was 6.9%. The size reduction was accompanied with an increase of 105 pmho/cm in particle conductivity.

Similarly, the effect of S-1 was tested on El 3.1. 1% of S-1 was added to El 3.1 and the combination was ground for 2 hours. Upon completion of the grinding cycle, the particle size of the El 3.1 was evaluated and it was found that the particle size did not significantly change from 6.28 to 6.15 microns. However, the tail decreased from 4.26 to 0.72%.

With the present exemplary charge adjuvants proven to provide enhanced chargeability with reduced process time, actual use of the adjuvants on printing was tested. According to one exemplary embodiment, attritor MODEL 01HD (Union Process) containing 3/16 inch balls chrome still media cooled to ca. 30° C. and was charged with 200 gram El 3.1 and 1.35 grams of the Yttrium based Y-1 charge adjuvant. The mixture was ground for approximately 120 min. A 2% solution (diluted by Isopar L) of the mixture was then charged by an NCD 10 (commercial charge director) and equilibrated over night. The PC of the resulting solution measured 150 pmho/cm. The 2% liquid developer was printed by an HP Indigo press 3000. The above-mentioned experiment was then repeated with an untreated El 3.1 containing only 1% aluminum stearate.

During the experimental printing, the press was auto calibrated by look up table (LUT) for each of the inks. Cyan O.D-1.55 is the lowest OD that could be attained upon auto calibration of the system for El 3.1. Consequently, OD 1.55 was determined for El 3.1 modified with 3% Y-1. El 3.1 +4% Y-1 could not be automatically calibrated since Cyan O.D 1.55 was too high. In the case of El 3.1+4%Y-1 the color was adjusted to 1.45 (without the LUT calibration). The printing parameters are illustrated in Table 2 below:

TABLE 2

| | Electrode Potential [V] | Developer potential [V] | Squeegee Potential [V] | Cleaning Roll Potential [V] | Laser Power |
|---|---|---|---|---|---|
| 1 EI 3.1 | 1018 | 337 | 712 | 87 | 15 |
| 2 EI 3.1 + 3% Y-1 | 1025 | 389 | 764 | 139 | 15 |
| 3 EI 3.1 + 4% Y-1 | 1294 | 658 | 1033 | 408 | 1 |

As observed after the above-mentioned printing, Addition of Y-1 to El 3.1 improved the printing results significantly. It is important to emphasize that the PC of El 3.1 is 123 pmho/cm while the PC of El 3.1+3% Y-1 is 150. The relatively small increase in PC compared to the improvement in the print quality may indicate that Y-1 exerts another positive effect on the electrical properties of El 3.1. The behavior of El 3.1+4% Y-1 in the press and the printing results indicate that the developer is charged to a relatively high degree.

While the above-mentioned experiments are were performed using an industrial dispersing tool, the acceptability of the present Yttrium and Scandium based charge adjuvants was also tested using non-industrial dispersing tools. According to one exemplary embodiment, the following charge adjuvants were used:

1. Aluminum stearate supplied by sigma Aldrich Israel.
2. Yttrium (III) 2-ethylhexanoate 99.9% CAS 114012-65-6, referred to herein as Y-1, supplied by sigma Aldrich Israel.
3. Yttrium (III) acetylacetonate hydrate 99.99% CAS 207801-29-4, referred to herein as Y-2, supplied by sigma Aldrich Israel.
4. Yttrium (III) tris (2,2,6,6-tetramethyl-3,5-heptanedionate) CAS 15632-39-0, referred to herein as Y-3, supplied by sigma Aldrich Israel.
5. Scandium(III) tris(2,2,6,6-tetramethyl-3,5-heptanedionate) hydrate CAS #307532-33-8 referred to herein as S-1, supplied by sigma Aldrich Israel The following exemplary experiments were performed using glass vials. The above-mentioned Yttrium charge adjuvants were introduced into a developer 2% (solids) dispersion by Heidolph (UK) small high shear mixer (SHSM) model DIAK 100 electronic motor with mixing device TYP 8 G/100 at 20 k RPM. For each of the above charge adjuvants, 6 different concentrations were tested, namely 1, 2, 3, 4, 6 and 8% on the solids in the developer. The results are illustrated in table 3 below and in FIG. 10.

TABLE 3

| | | Concentration | | | | | | | | | | | |
|---|---|---|---|---|---|---|---|---|---|---|---|---|---|
| | | 1% | | 2% | | 3% | | 4% | | 6% | | 8% | |
| | Adjuvant | PC | DC | PC | DC | PC | DC | PC | DC | PC | DC | PC | DC |
| 1 | Aluminum Stearate | 89 | 4 | 100 | 3 | 106 | 3 | 106 | 3 | 119 | 3 | 119 | 3 |
| 4 | Y-1 | 90 | 3 | 111 | 4 | 107 | 4 | 237 | 5 | 437 | 9 | 500 | 13 |
| 5 | Y-2 | 76 | 3 | 159 | 3 | 302 | 3 | 401 | 6 | 495 | 10 | 527 | 12 |
| 6 | Y-3 | 92 | 3 | 91 | 4 | 126 | 3 | 193 | 4 | 260 | 5 | 428 | 7 |

Figure 10:
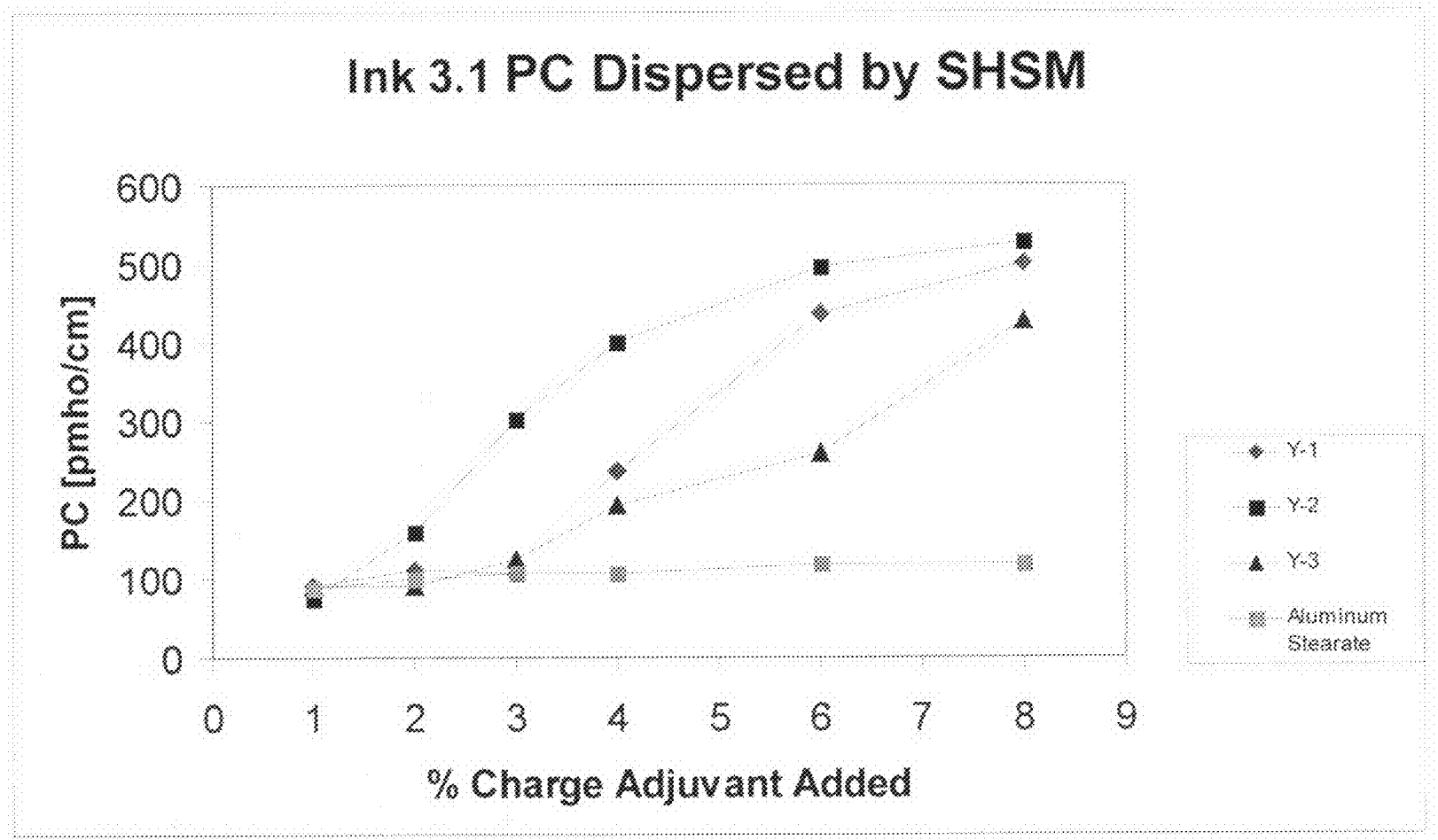
FIG. 10 is a chart illustrating the effects of charging a diluted developer dispersion with various Yttrium based charge adjuvants, according to one exemplary embodiment.

As illustrated in FIG. 10 and Table 3, the charging of a diluted liquid developer, similar to the concentration used for example in a printing system, can be enhanced upon adding the disclosed charge adjuvants. Note that aluminum stearate, as well as other charge adjuvants such as aluminum laurate and Yttrium stearate, not illustrated in Table 3 or FIG. 10, behave similar to aluminum stearate and were not shown to increase the PC significantly.

In a separate experiment 2% (on the solids of the developer) of Scandium(III) tris(2,2,6,6-tetramethyl-3,5-heptanedionate) hydrate was introduced into a 2% El 3.1 solution. The S-1 was dispersed by a Heidolph (UK) small high shear mixer (SHSM) model DIAK 100 electronic motor with mixing device TYP 8 G/100 at 20 k RPM for 20 min. The original particle conductivity of the ink was 123 pmho/cm. After grinding, the conductivity increased to 260 pmho/cm while the DC increase was minor; 4 compared to 7 pmho/cm.

In conclusion, the disclosure provides a system and method for controlling particle conductivity in a liquid developer used for developing an electrostatic latent image. According to one exemplary embodiment, a insoluble Yttrium based charge adjuvant is selectively disposed in a ready made liquid developer to increase the charge of the liquid developer. Of particular significance is the fact that the present Yttrium based charge adjuvant impart a high charge with relatively little grinding.

The preceding description has been presented only to illustrate and describe exemplary embodiments of the present system and method. It is not intended to be exhaustive or to limit the system and method to any precise form disclosed. Many modifications and variations are possible in light of the above teaching. It is intended that the scope of the system and method be defined by the following claims.

What is claimed is:

1. A method for enhancing a chargeability of a liquid developer, comprising:

presenting said liquid developer; and combining a Group 3 based charge adjuvant with said liquid developer, wherein said Group 3 based charge adjuvant comprises at least one of a Yttrium (III) 2-ethylhexanoate, a Yttrium (III) acetylacetonate hydrate, Yttrium (III) tris (2,2,6,6-tetramethy-3,5-heptanedionate) or a Scandium(III) tris(2,2,6,6-tetramethy-3,5-heptanedionate) hydrate.

2. The method of claim 1, further comprising grinding said liquid developer and said Group 3 based charge adjuvant for less than 5 hours.

3. The method of claim 1, further comprising grinding said liquid developer and said Group 3 based charge adjuvant for less than 1 hour.

4. The method of claim 1, wherein said Group 3 based charge adjuvant is added to said liquid developer at between 1 and 6% by wt.

5. The method of claim 1, wherein said liquid developer comprises a charge diluted developer.

6. The method of claim 1, further comprising adding said Group 3 based charge adjuvant to said liquid developer during a grinding of said liquid developer, wherein said Group 3 based charge adjuvant functions as a grind aid.

7. A method for enhancing a chargeability of a liquid developer, comprising:

presenting said liquid developer;

dispersing at least one of an Yttrium or a Scandium based charge adjuvant into said liquid developer, wherein said at least one Yttrium or Scandium based charge adjuvant comprises at least one of a Yttrium (III) 2-ethylhexanoate, a Yttrium (III) acetylacetonate hydrate, Yttrium (III) tris (2,2,6,6-tetramethy-3,5-heptanedionate), or a Scandium(III) tris(2,2,6,6-tetramethy-3,5-heptanedionate) hydrate; and grinding said liquid developer and said at least one Yttrium or Scandium based charge adjuvant for less than 2 hours to impart a charge on said liquid developer.

8. The method of claim 7, wherein grinding said liquid developer and said at least one Yttrium or Scandium based charge adjuvant comprises grinding said liquid developer and said at least one Yttrium or Scandium based charge adjuvant for less than 30 minutes.

9. The method of claim 7, wherein said at least one Yttrium or Scandium based charge adjuvant is dispersed into to said liquid developer at between 1 and 6% by wt.

10. The method of claim 7, wherein said liquid developer comprises a charge diluted developer.

11. The method of claim 7, further comprising adding said at least one Yttrium or Scandium based charge adjuvant to said liquid developer during a grinding of said liquid developer, wherein said at least one Yttrium or Scandium based charge adjuvant functions as a grind aid.

12. The method of claim 7, in which chargeability of said liquid developer is attained after particle size, particle size distribution, and color strength of said liquid developer have been attained.

13. The method of claim 7, in which grinding said liquid developer further comprising grinding said liquid developer and said at least one Yttrium or Scandium based charge adjuvant at an elevated temperature, said elevated temperature comprising temperatures of 30° C. and higher.

14. A liquid developer, comprising:

a binder;

a plurality of toner particles dispersed in said binder; and a charge adjuvant dispersed in said liquid developer;

wherein said charge adjuvant comprises at least one Yttrium or Scandium based charge adjuvant, in which said at least one Yttrium or Scandium based charge adjuvant comprises one of a Yttrium (III) 2-ethylhexanoate, a Yttrium (III) acetylacetonate hydrate, Yttrium (III) tris (2,2,6,6-tetramethy-3,5-heptanedionate), or a Scandium(III) tris(2,2,6,6-tetramethy-3,5-heptanedionate) hydrate.

15. The liquid developer of claim 14, wherein said at least one Yttrium or Scandium based charge adjuvant comprises between 1 and 6% by weight of said liquid developer.

16. The liquid developer of claim 14, further comprising at least one Yttrium or a Scandium based grinding aid.

* * * * *

UNITED STATES PATENT AND TRADEMARK OFFICE

CERTIFICATE OF CORRECTION

PATENT NO. : 7,794,910 B2
APPLICATION NO. : 11/701017
DATED : September 14, 2010
INVENTOR(S) : Hannoch Ron et al.

It is certified that error appears in the above-identified patent and that said Letters Patent is hereby corrected as shown below:

In column 12, line 16, in Claim 1, delete “tetramethy” and insert -- tetramethyl --, therefor.

In column 12, line 17, in Claim 1, delete “tetramethy” and insert -- tetramethyl --, therefor.

In column 12, line 57, in Claim 7, delete “tetramethy” and insert -- tetramethyl --, therefor.

In Column 12, line 58, in Claim 7, delete “tetramethy” and insert -- tetramethyl --, therefor.

In column 14, line 10, in Claim 14, delete “tetramethy” and insert -- tetramethyl --, therefor.

In column 14, line 11, in Claim 14, delete “tetramethy” and insert -- tetramethyl --, therefor.

Signed and Sealed this
Eleventh Day of October, 2011

David J. Kappos

David J. Kappos
*Director of the United States Patent and Trademark Office*